United States Patent [19]

Churchill

[11] Patent Number: 4,643,428

[45] Date of Patent: Feb. 17, 1987

[54] GOLF CLUB GRIPPING AID

[76] Inventor: George R. Churchill, 61 Broad Reach M-59, Weymouth, Mass. 02191

[21] Appl. No.: 751,485

[22] Filed: Jul. 3, 1985

[51] Int. Cl.[4] ..... A63B 53/14; A63B 69/36

[52] U.S. Cl. ..... 273/166; 273/DIG. 30; 2/161 A

[58] Field of Search ..... 273/165, 183 B, 166, 273/DIG. 30; 2/161 A, 160

[56] References Cited

U.S. PATENT DOCUMENTS 3,249,359 5/1966 Goldberger ..... 273/166

4,502,688 3/1985 Papp ..... 273/189 A

*Primary Examiner*—George J. Marlo

*Attorney, Agent, or Firm*—Robert R. Churchill

[57] ABSTRACT

In combination with a golf glove, a strap for maintaining a golfer's hands in close relatively tight relation to each other when the golf club is gripped for hitting a golf ball. The strap includes a loop at one end into which the golfer's right thumb is placed, if the golfer is right handed and the left thumb if the golfer is left handed. The strap is provided at its other end with an attachment device for detachably securing that end of the strap to the golfer's glove overlying the back of the left hand of the golfer or right hand if the golfer is left handed. The attachment device comprises a plurality of hook and loop members mounted on a pad attached to the free end of the strap and arranged to intermesh with a material including loops and hooks secured to the golfer's glove closure.

In use the attachment device is detachably pressed into the hooks and loops on the golf glove meshing therewith. The glove is placed on the golfer's left or right hand as the case may be and the thumb of the other hand is inserted into the loop of the strap. The golf club is gripped by the gloved hand and other hand grips the club and overlys a portion of the gloved hand and is held snugly against said hand during the golf swing.

2 Claims, 3 Drawing Figures

GOLF CLUB GRIPPING AID

BACKGROUND OF THE INVENTION

The present invention resides in the field of golf training equipment and to a strap for properly positioning the golfer's hands during the golf swing.

DESCRIPTION OF THE PRIOR ART

Prior to the present invention substantially all of the devices adapted for the use in an attempt to help the golfer make the proper golf swing and consequently hit the golf ball correctly have involved a series of rather complicated straps connected around a part of the golfer's wrist and hand an sometimes would be connected to the golfer's belt. Other such devices involve an elastic strap hooked around the right thumb and then connected to the wrist. This would inevitably impair the swing rather than help it. There are other devices for keeping the head down during the swing, but involve a series of straps and are not believed pertinent.

The present novel and improved device provides a new concept wherein an integral strap provided with a loop at one end into which the golfer's right thumb maybe placed and means at the opposite end of the strap for detachably securing the strap to the golfer's golf glove. The strap is held in position relative to the glove and by the glove so that it holds the golfer's hands firmly yet comfortably together during the swing.

FIELD OF THE INVENTION

The invention has for a principal object to provide a novel and improved golf strap particularly constructed and arranged to correctly position the golfer's hands for a sound and correct golf swing and to maintain such hand position during the swing.

Another object of the invention is to provide a training device for use in practicing the golf swing which is economical to manufacture and simple to use while helping the golfer to perfect his golf swing.

A still further object of the invention is to provide a novel and improved training strap for use with a standard golf glove having closure strap including a fastening device formed of mating hooks and loops, such as one sold under the trademark "VELCRO", for securing the glove in position on the golfer's hand which maintains the left and right hands together throughout the entire swing whereby the hands act as one during the swing and hitting action.

Another object of the invention is to provide a training device which constructed such that it is easy to apply and secure to operative position and easily removable after use.

Still another object is to provide a novel and improved golf training device for developing hand coordination and the creation of muscle memory providing a solid golf game.

DRAWING

In the drawing illustrating the preferred embodiment of the invention:

SUMMARY OF THE INVENTION

Figure 1:
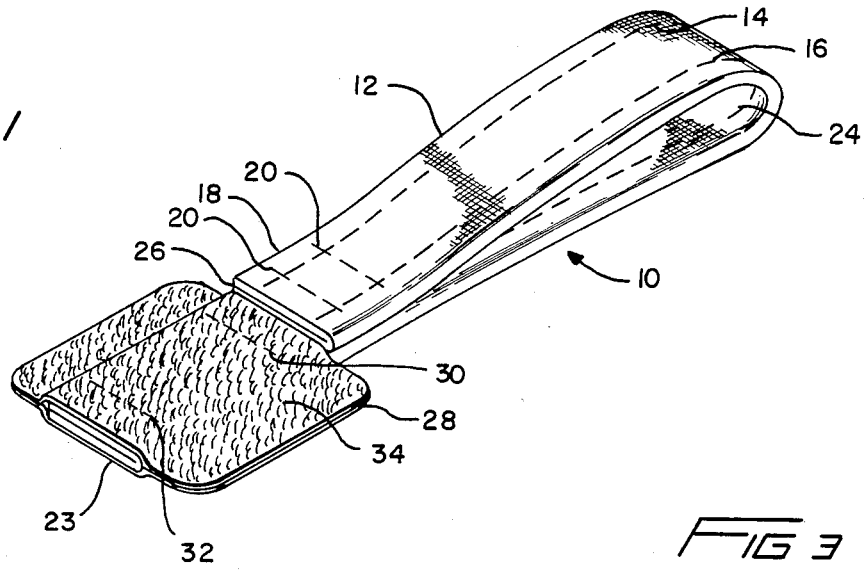
FIG. 1 is a perspective view illustrating the present golf strap showing the "VELCRO" pad.

Referring now to the drawings illustrating the preferred embodiment of the invention and to FIG. 1 in particular 10 represents the present training strap which consists of a length of fabric 12 folded upon itself and stitched together by two rows of longitudinal stitching 14, 16 as shown. The length of folded and stitched fabric is then folded upon itself with the free end 18 secured by means of two staples 20, 20 such that its end is positioned inwardly of the end 23 of the strap to which it is secured. Thus a loop 24 is formed by the folded and secured portions of the fabric material. In accordance with the invention the fabric maybe either cotton or synthetic fabric such as nylon and the strap maybe secured upon itself by means other than by staples. Stitching or adhesive maybe used.

The present device is preferably of three sizes, small, medium and large to accommodate golfers having hands of different sizes. Preferably but not by way of limitation the small size strap is about $5\frac{1}{2}''$ in overall length, the medium 6" overall length and the large size $6\frac{1}{2}''$ overall length.

Figure 2:
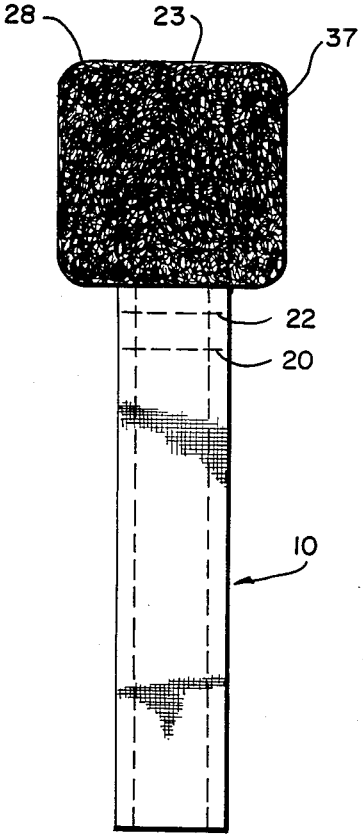
FIG. 2 is a similar perspective view of the other side of the strap with the fabric pad for cooperation with the "VELCRO" on the golf glove closure strap.

It will be understood that in each size of the present strap the end of the folded over portion or leg of the strap is spaced the same distance from the free end of the underlying strap portion to which it is secured. In each case its distance from the free end is 2". The purpose of this unoverlapped portion 26 of the folded strap is to accommodate a 2"×2" piece of "VELCRO" material 28 of the type that maybe readily purchased on the market. As shown in FIGS. 1 and 2 the "VELCRO" piece is secured in position as shown by means of staples 30, 32 which firmly secure it to the looped strap 10. As illustrated the "VELCRO" hooks 34 are positioned to lie on unoverlapped portion 26 with the softer surface 37 including loops on the opposite side of the strap.

An important feature of the present invention resides in the fact that the present strap is non-stretchable and when in operative position relative to the golf glove with which it is used maintains the hands in an immovable relation one to the other throughout the golf swing.

Figure 3:
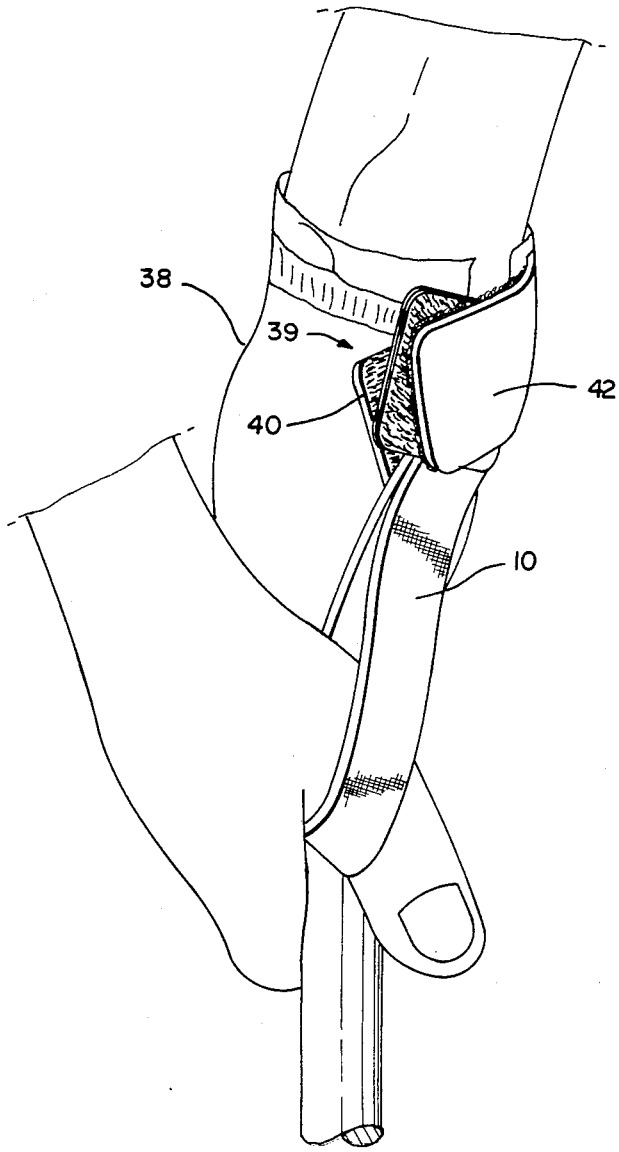
FIG. 3 is a front elevation of the golfer's hands in position gripping the golf club with the present device in position over the golfer's right thumb and secured to the glove by and between the glove closure flap.

Referring now to FIG. 3 in particular for an illustration and description of how the present novel and improved training strap cooperates with the golf glove to provide a novel and improved training device for use in improving the golfers swing on the practice range or on the course.

The golf glove 38.comprises a standard glove shown as a glove for the left hand having a "VELCRO" closure 39 which is securely positioned on the golfer's hand by means of a stationary "VELCRO" pad 40 secured along one side of the glove opening and a flap 42 covered with a soft fabric secured to the other side of the glove opening into which the golfer's left hand 43 is inserted. As shown in FIG. 3 the training strap is positioned diagonally over the stationary "VELCRO" pad 40 to position the loop portion at an angle between the golfer's right hand thumb and fore finger. The thumb of the right hand 44 being positioned within the loop 24 as already illustrated. At this time the flap 42 is folded over and pressed on the "VELCRO" pad 40 thus securing the glove on the hand and the strap 10 in position so that hands are held firmly together when the club is gripped as shown.

Preparatory to making the golf swing the golfer slips his glove on his left hand places the training strap in position diagonally across the stationary "VELCRO" pad on the glove and closes the glove by apply the fabric glove pad to the "VELCRO" portion of the strap. He then grips the club with his left hand and inserts his right thumb into the loop of the strap and grips the club fully with the fingers of this right hand. During the full swing the golfer's hands will be maintained in proper position by the present training strap.

It will be understood that the present strap maybe used equally as well by left-handed golfers wearing the gclf glove on the right hand.

Which the preferred embodiment of the present invention have be illustrated and described herein it will be understood that other variations maybe made in the training strap without departing from the scope of this invention.

From the foregoing description it will be apparent that the present invention provides a novel and improved training device simple to use and economical to manufacture whereby practice utilizing the novel strap improves the golfers swing and consequently his overall golf game. Thus the object of the invention is to improve and perfect the golfers hand coordination it will be understood it will be of substantial assistance in every part of the game, from putting strokes to fairway and tee shots.

Having thus described the invention, what is claimed is:

1. A golf training strap and a golf glove having closing flaps having a plurality of hooks and loops, said hooks and loops meshing with each other to securely position the glove on the golfer's hand, said strap and glove combination used to develop the golfer's hand coordination, said strap comprising a length of non-stretchable fabric folded upon itself and stitched to form a relatively narrow length of strapping, one end of said strap folded over and secured to the other portion of the strap at a point spaced a distance from its free end to form therewith a loop, and a pad having a first surface of material including loops on one side and a second surface of hooks on the other side secured to the unoverlapped portion of the strap, said pad being positioned between the glove closure flaps and secured to said glove by meshing, respectively, the hooks and loops of the glove with loops and hooks on the pad.

2. A golf training strap and glove as described in claim 1, wherein the strap fabric is folded upon itself and secured in position by longitudinal rows of stitching and whereby the pad is secured to the strap by means of staples.

* * * * *